US007938045B2

(12) United States Patent
Itoh

(10) Patent No.: US 7,938,045 B2
(45) Date of Patent: May 10, 2011

(54) DRIVING TOOL

(75) Inventor: Takashi Itoh, Meguro-ku (JP)

(73) Assignee: Marushin Hong Kong Limited, Hong Kong (CN)

( * ) Notice: Subject to any disclaimer, the term of this patent is extended or adjusted under 35 U.S.C. 154(b) by 0 days.

(21) Appl. No.: 11/628,528

(22) PCT Filed: Aug. 31, 2006

(86) PCT No.: PCT/JP2006/017192

§ 371 (c)(1),
(2), (4) Date: Nov. 30, 2006

(87) PCT Pub. No.: WO2008/026274

PCT Pub. Date: Mar. 6, 2008

(65) Prior Publication Data

US 2009/0158901 A1 Jun. 25, 2009

(30) Foreign Application Priority Data

Aug. 30, 2006 (JP) ..... 2006-233981

(51) Int. Cl.
*B25B 23/16* (2006.01)
*B25G 1/08* (2006.01)

(52) U.S. Cl. ..... 81/439; 81/177.4; 81/490

(58) Field of Classification Search ..... 81/439, 81/177.4, 490, 440; 7/167, 165
See application file for complete search history.

(56) References Cited

U.S. PATENT DOCUMENTS

| | | | | |
|---|---|---|---|---|
| 4,241,773 | A * | 12/1980 | Personnat | 81/177.4 |
| 4,552,044 | A * | 11/1985 | Corona et al. | 81/490 |
| 5,228,363 | A * | 7/1993 | Corona et al. | 81/439 |
| 6,327,942 | B1 * | 12/2001 | Mariol et al. | 81/177.4 |
| 6,701,814 | B2 * | 3/2004 | Purkapile | 81/490 |
| 6,845,694 | B2 * | 1/2005 | Ping | 81/440 |

FOREIGN PATENT DOCUMENTS

| | | |
|---|---|---|
| JP | 61-136778 | 6/1986 |
| JP | 62-188364 | 11/1987 |
| JP | 4-505585 | 10/1992 |

* cited by examiner

*Primary Examiner* — Hadi Shakeri
(74) *Attorney, Agent, or Firm* — Jordan and Hamburg LLP

(57) ABSTRACT

A driving tool including a guide groove shaped as a long hole receives a driver bit such that a portion thereof excluding its support is projectable outside of the handle body. The base material has the outline shape of the supporter of the driver bit and is formed so that it might project to the inner side in the inside wall of the circumference wall by the side of the central part of the guide groove of the top plate of the cap. The locking piece is formed in the inner wall of the open end of the cap so that it can stop the rotation part which can prevent a plurality of driver bits from entering the guide groove of the cap.

2 Claims, 16 Drawing Sheets

DRIVING TOOL

BACKGROUND OF THE INVENTION

Conventionally, a bit selector is rotatably attached to the tip of the grip handle for choosing a driver bit stored in the grip handle. The selected driver bit selected by the selector becomes supported at the crevice of the handle tip, thereby making rotation of the bit difficult. The handle also forms the cap which houses a bit to be used and prevents unnecessary projection thereof. Thus, because the selector and the cap have been provided in the tip part of the grip handle, the structure has been complicated, costly, and further, the bits have been difficult to store.

SUMMARY OF THE INVENTION

In view of the above disadvantages, the present invention has few parts, thereby providing easy selection of the driver bit, as well as more convenient operation of the driving tool and storage of the driver bits. It is an object of the invention to prevent undesired projection of a driver bit or bits. Other objects of the invention include stabilizing movement of the selected bit when used, and providing for slidable selection of the bit to be used.

These and other objects of the invention will be apparent when referring to the accompanying drawings.

DETAILED DESCRIPTION OF THE INVENTION

Figure 1:
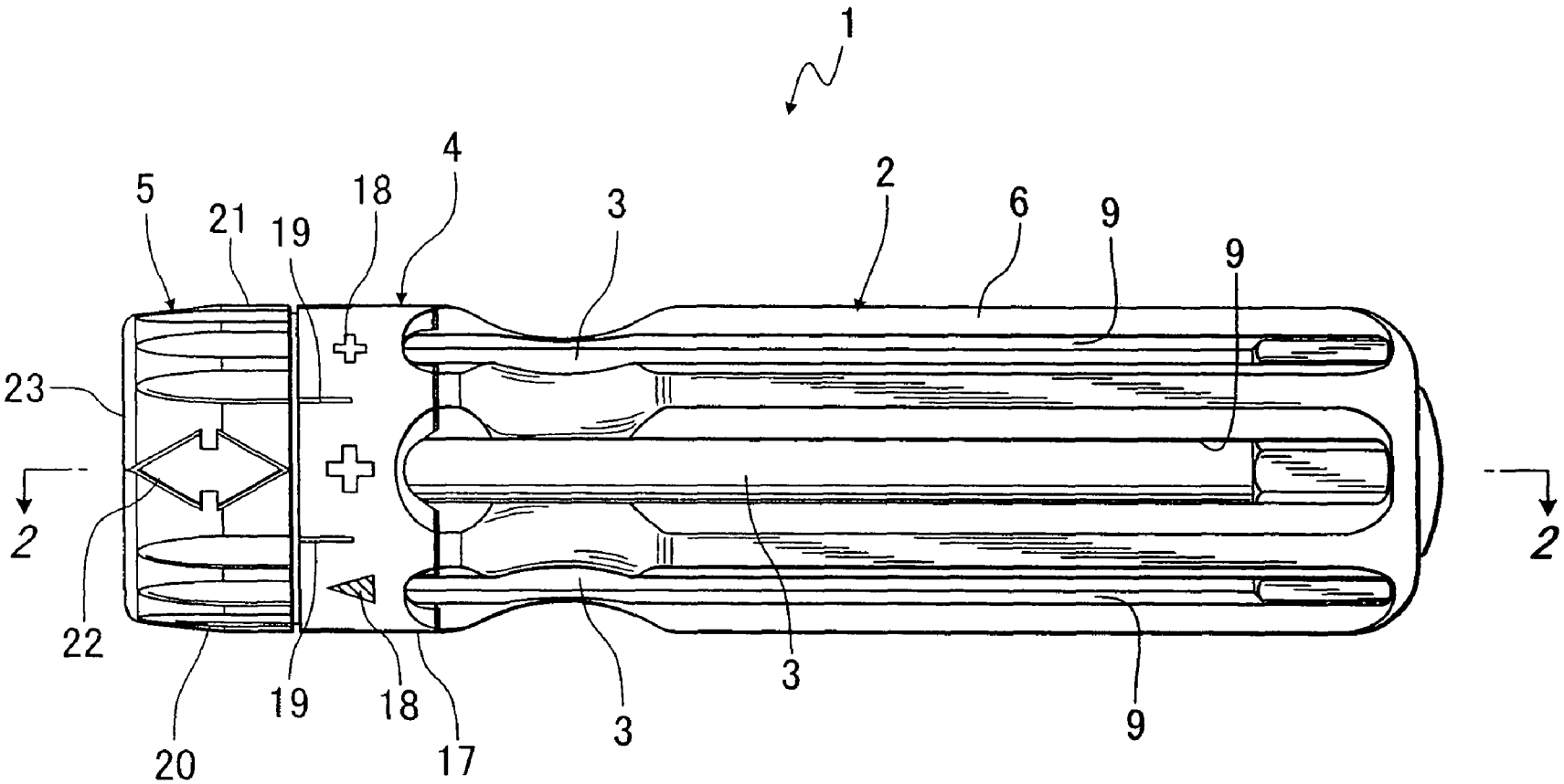
FIG. 1 is a front view of the driving tool of the invention.
Figure 2:
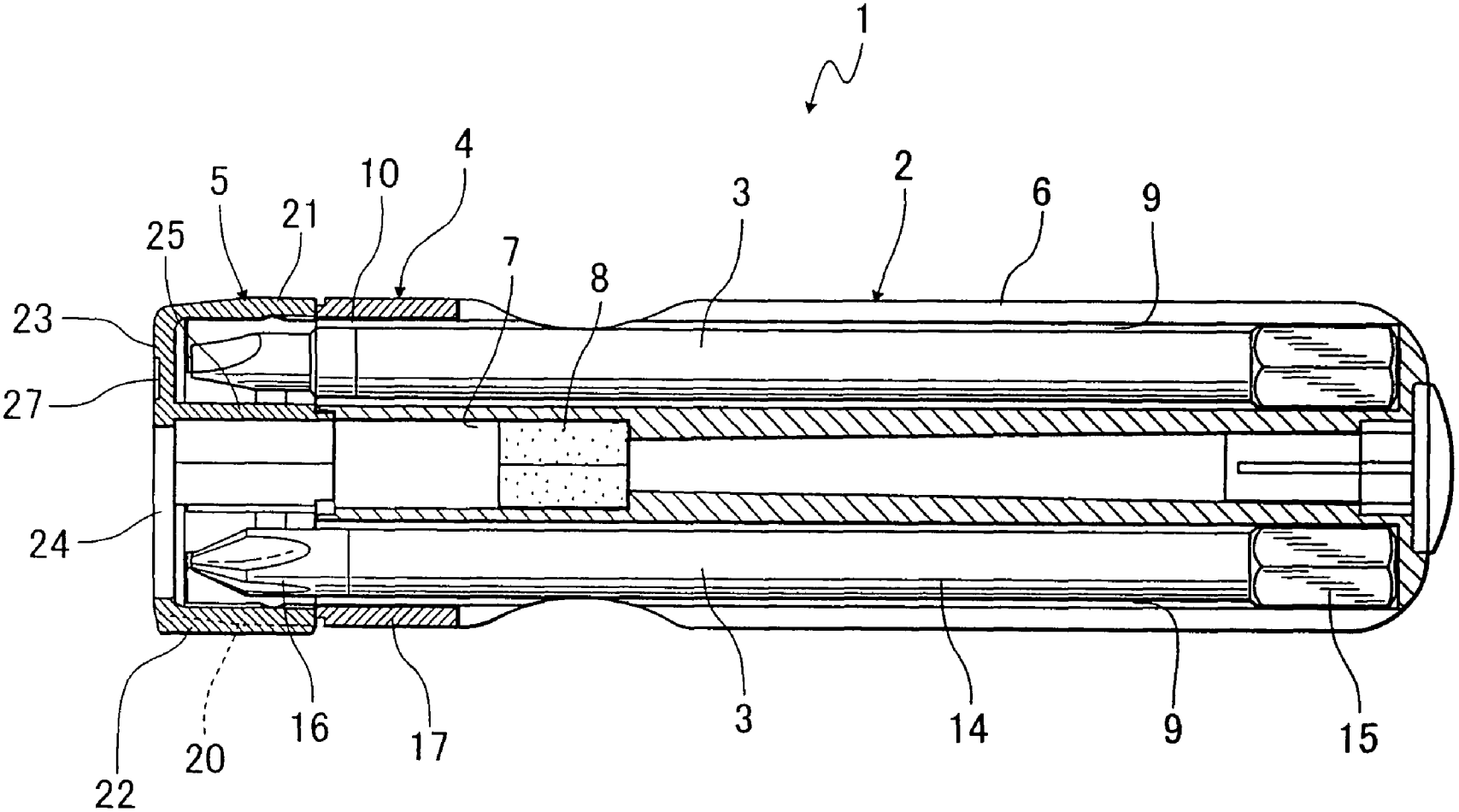
FIG. 2 is a cross section taken along 2-2 line of FIG. 1.
Figure 16:
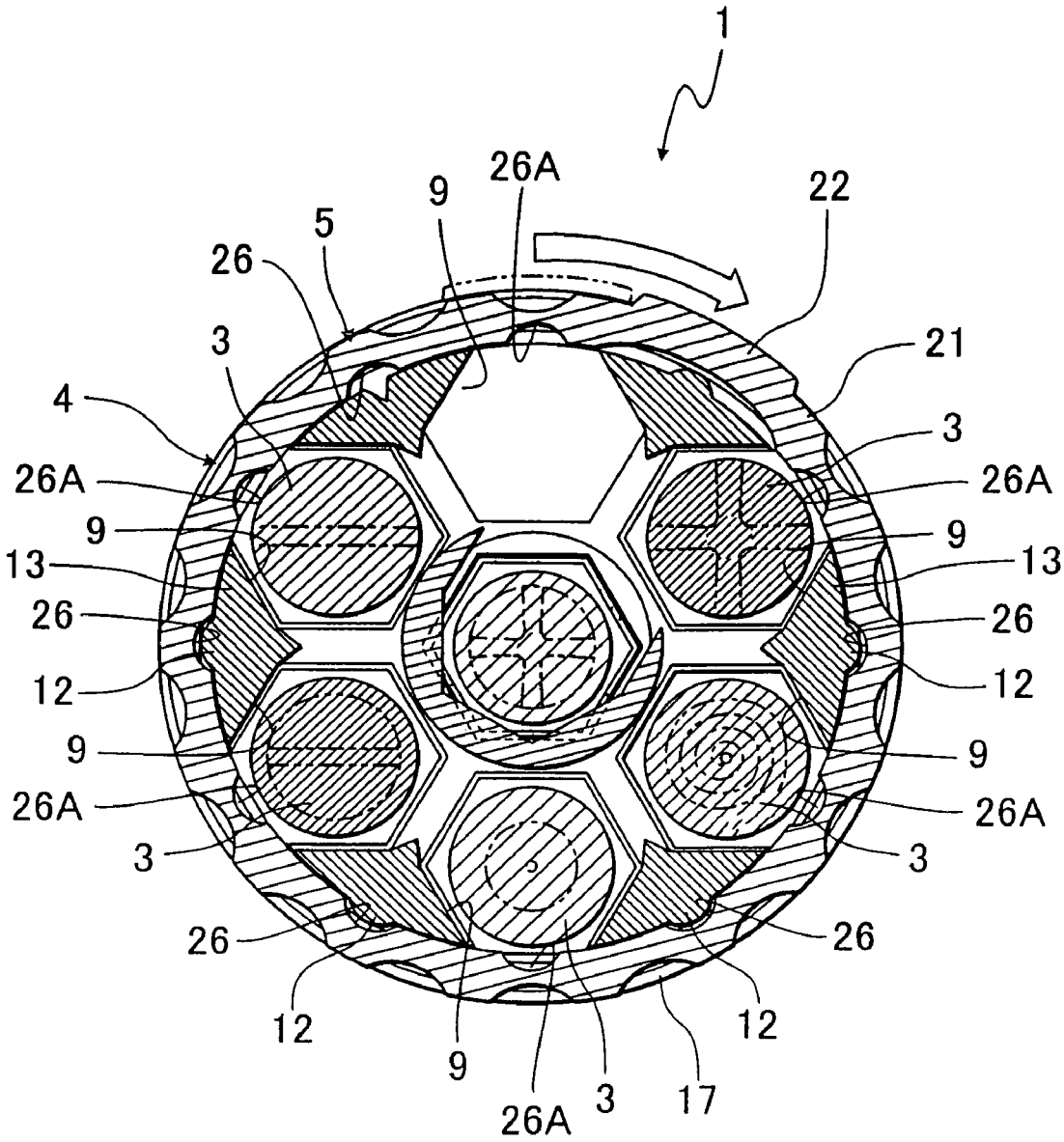
FIG. 16 is an expanded cross section taken along 18-18 line of FIG. 15.

As shown in FIG. 1 or FIG. 16, 1 is the driving tool of the present invention.

A driver bit 3 used with driving tool 1 is attached in the direction of an axial center with slide movement with the prescribed interval at the peripheral part of grip handle 2 of the driving tool 1, a retaining ring 4 is attached to the part of the tip part of the grip handle 2, and a cap 5 is attached to the tip part of the grip handle 2.

Figure 3:
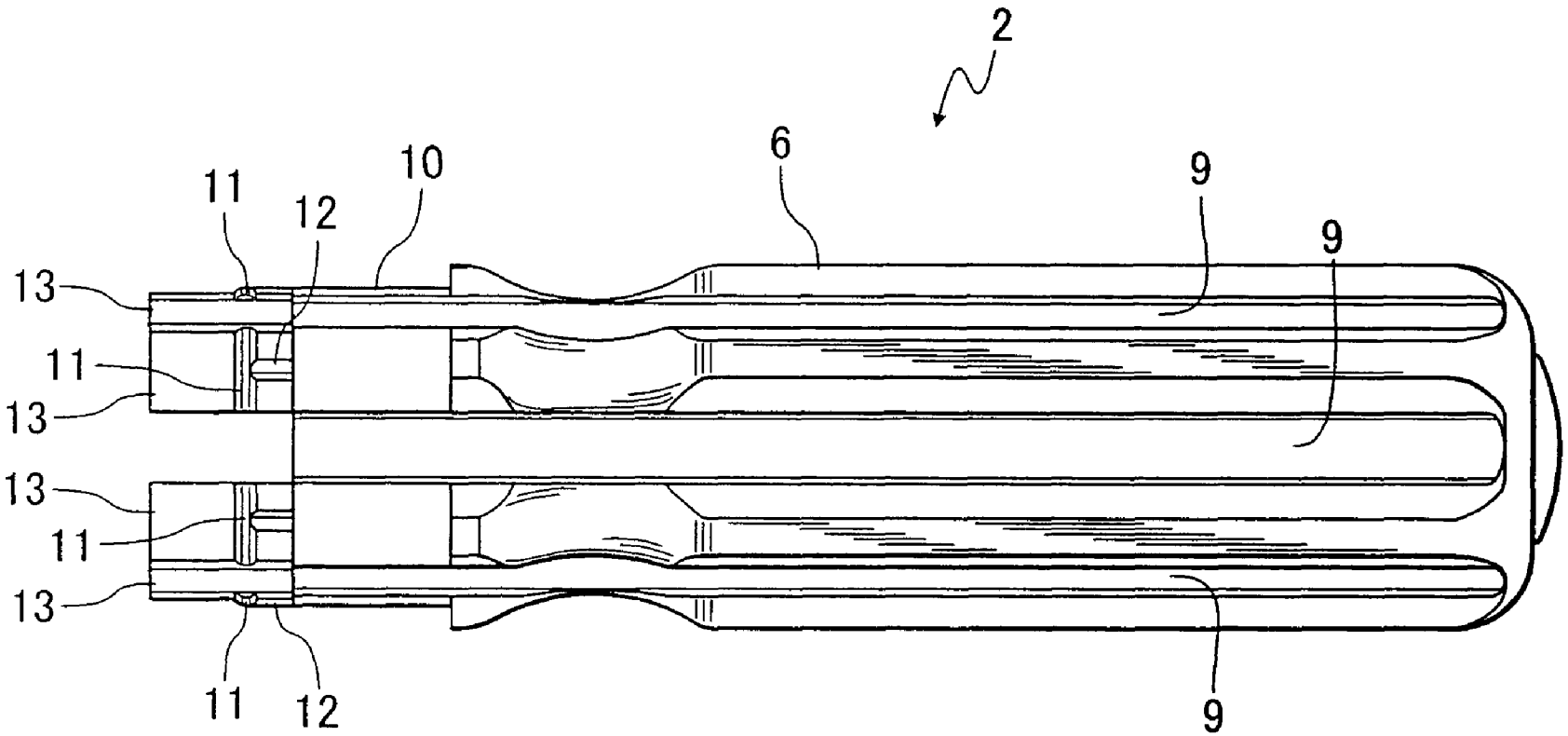
FIG. 3 is a front view of a grip handle of the driving tool of the invention.
Figure 4:
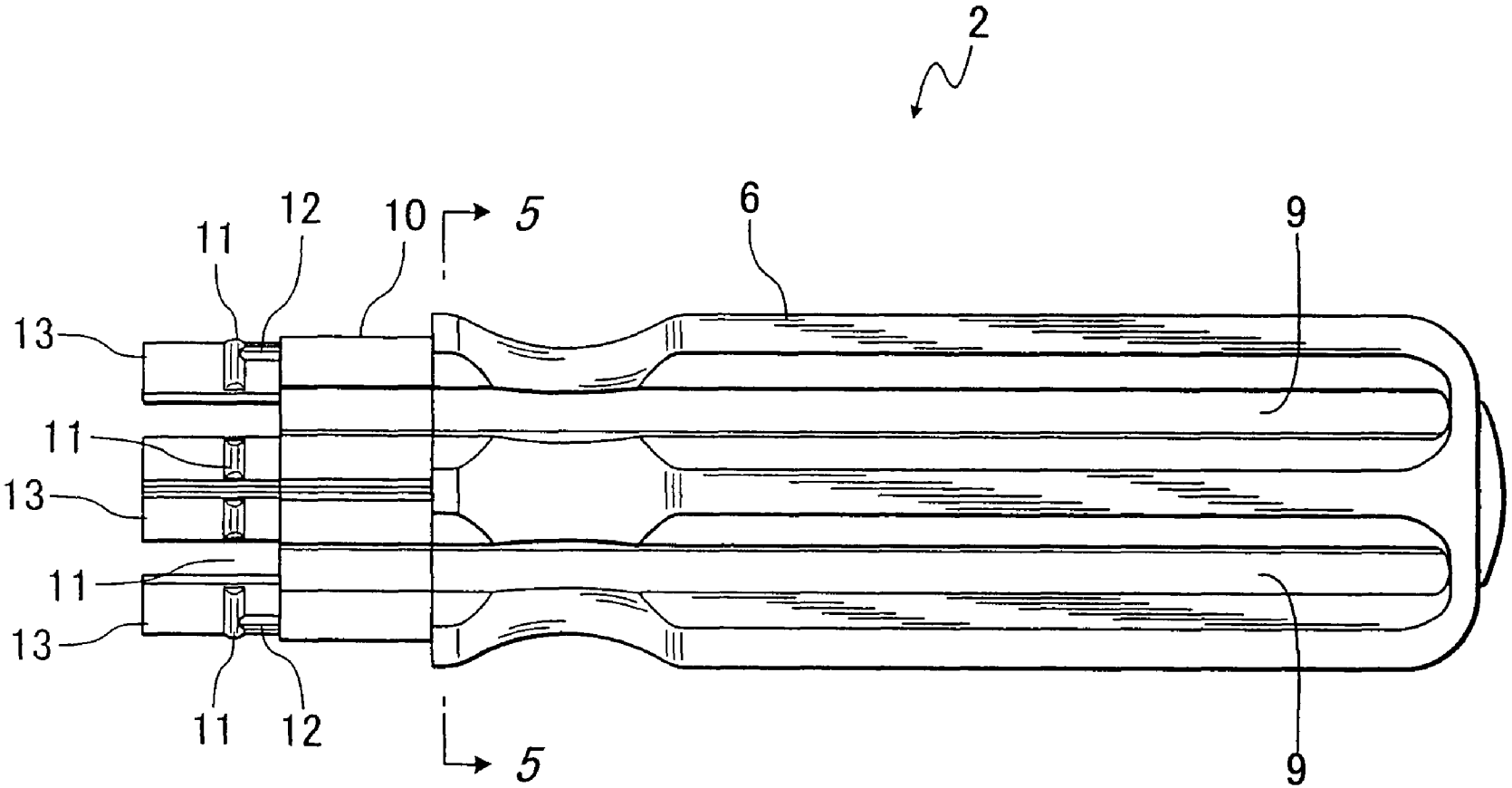
FIG. 4 is a top view of the grip handle of the invention.
Figure 5:
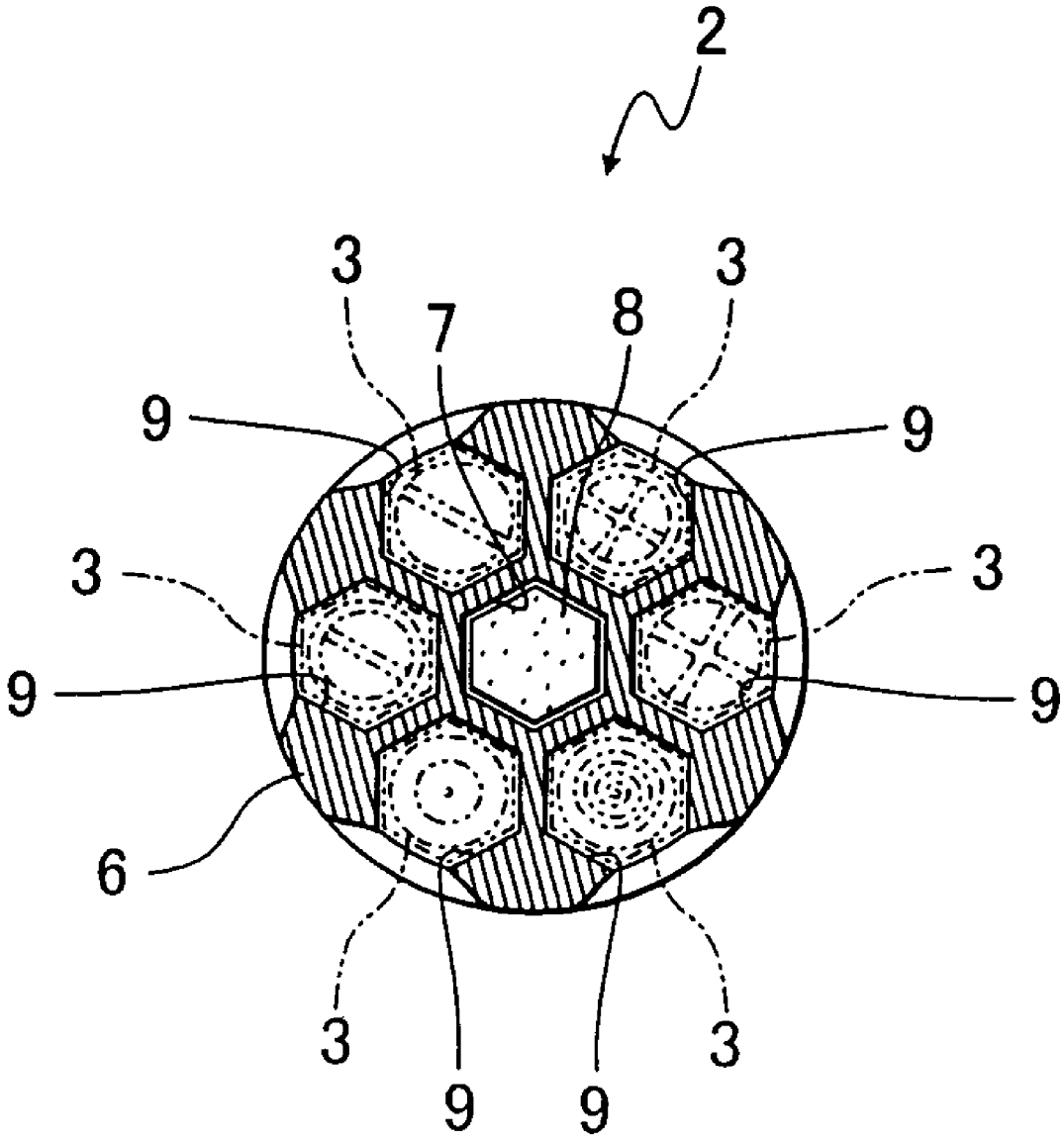
FIG. 5 is a cross section taken along 5-5 line of FIG. 4.
Figure 6:
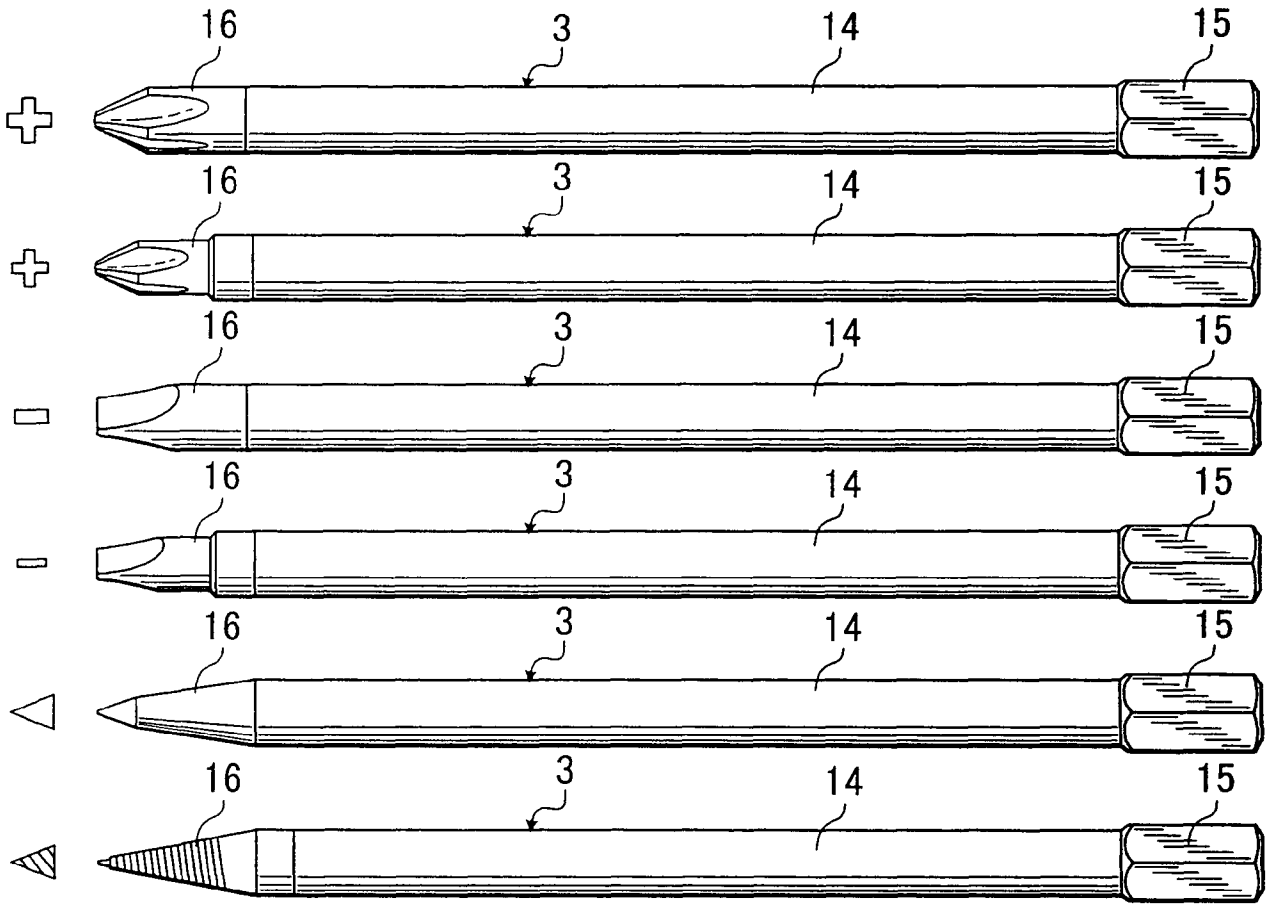
FIG. 6 illustrates the various selection of bits when using the driving tool.

The hand grip 2 comprises a grip handle body 6 shown in FIG. 3 or FIG. 5, and the driver bit 3 which is used for the central part of the tip part of the grip handle body 6 A support crevice 7 is formed by a groove of the shape of a hexagon and is removable and unrotatable to the rear end part of the driver bit 3, and a magnet 8 is attached so that the supporter of the driver bit 3 supported by this support crevice 7 could be adsorbed magnetically. Six driver bit insertion slots 9 are hexagonal in shape and receive the driver bit formed in the direction of the axial center with the prescribed interval at the peripheral part of main part 6 of the grip handle without being pulled out and are slidable to the said support crevice 7. A retaining ring supporter 10 is formed in the peripheral part of the tip part of the main part 6 of the grip handle, and an engaging projection 11 and a locking piece 12 are formed on the six pieces of the cap engaging parts 13, respectively. The engaging projection 11 and the locking piece 12 are formed by a part of the tip peripheral part of said grip handle body 6, and are formed in the lateral surface which projects adjacent slots 9. Driver bits 3 comprise a supporter 15 supported by said support crevice 7 and is hexagonal in shape.

Figure 7:
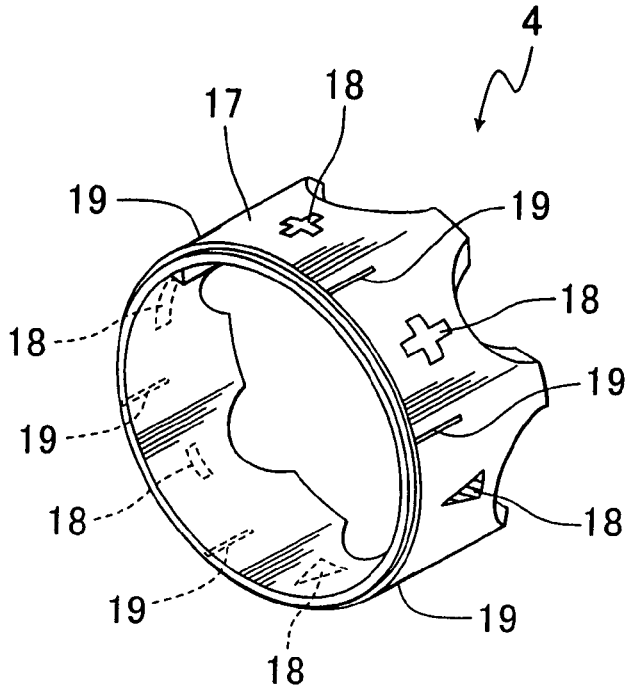
FIG. 7 is an explanatory view of a retaining ring of the driving tool.
Figure 17:
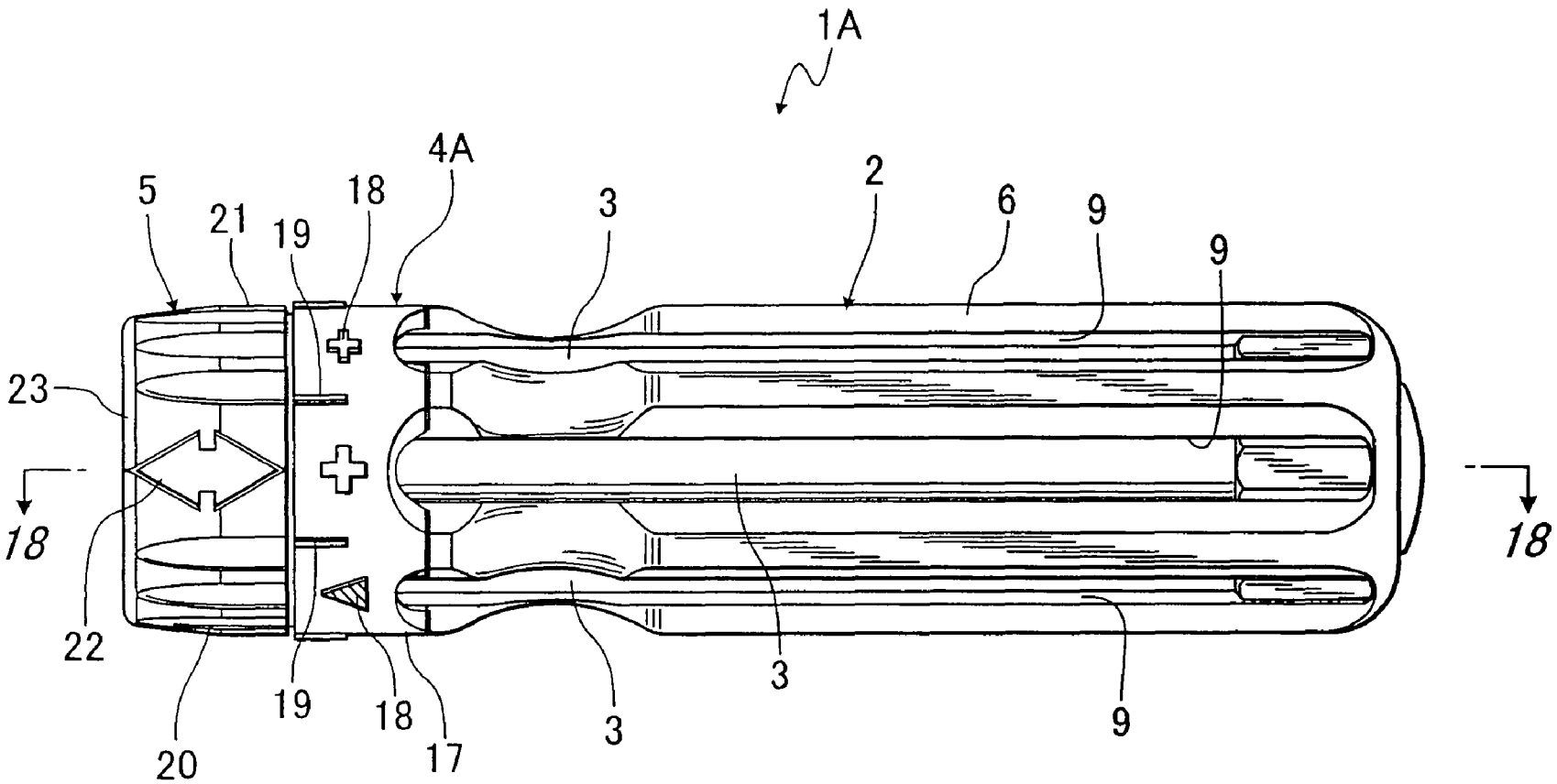
FIG. 17 is a front view of a second embodiment of the present invention.
Figure 18:
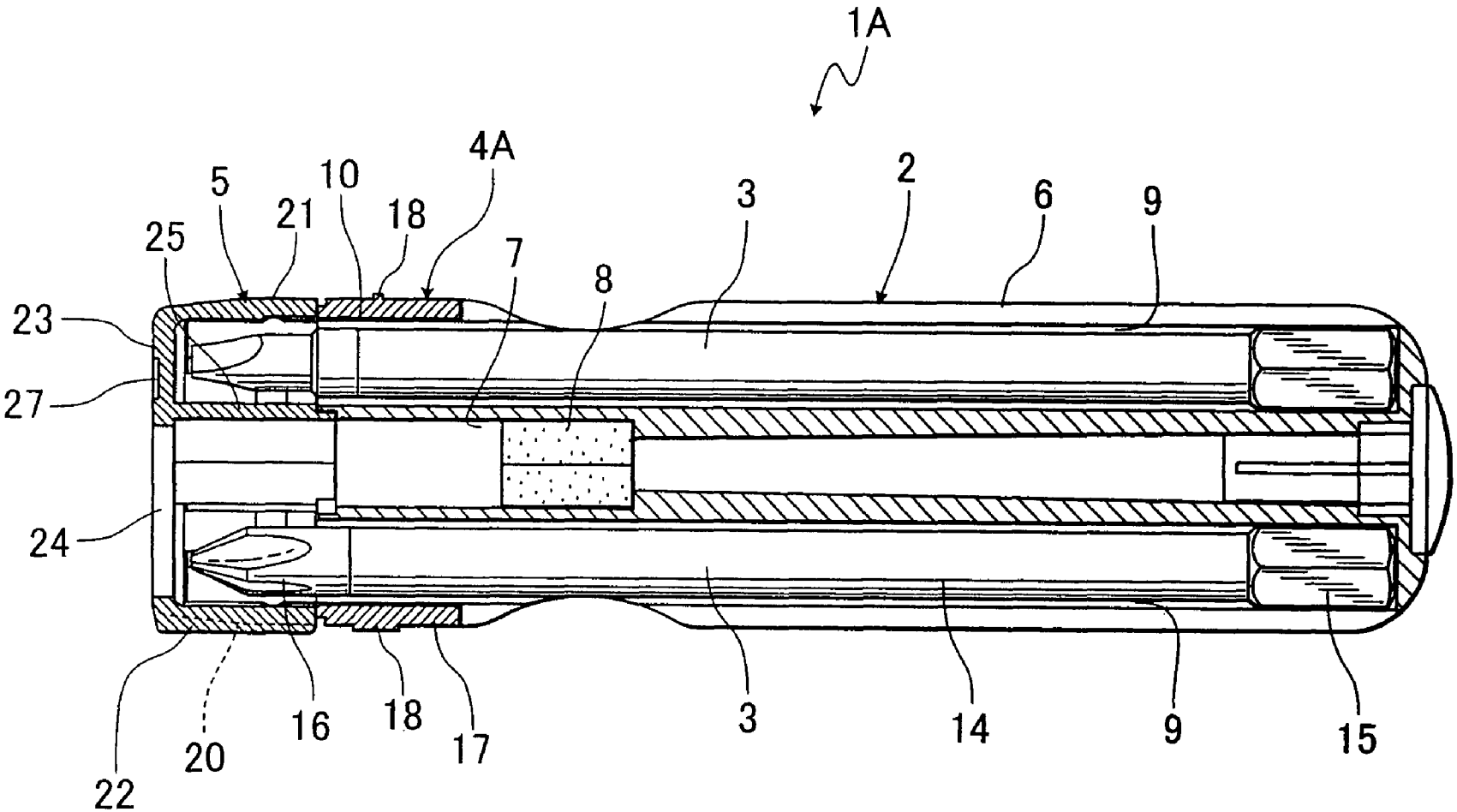
FIG. 18 is a cross section taken along 18-18 line of FIG. 17.

The retaining ring 4 and 17, as shown in FIGS. 7 and 17, respectively, are supported by a retaining ring supporter 10 of said grip handle main part 6. Driver bit indications 18 display the kind of driver bit and are printed on the peripheral part of the retaining ring main part 17, and the lock indications 19 are formed in the peripheral and tip part at the side of retaining ring main part 17 and are centered between each of the indications 18.

Figure 8:
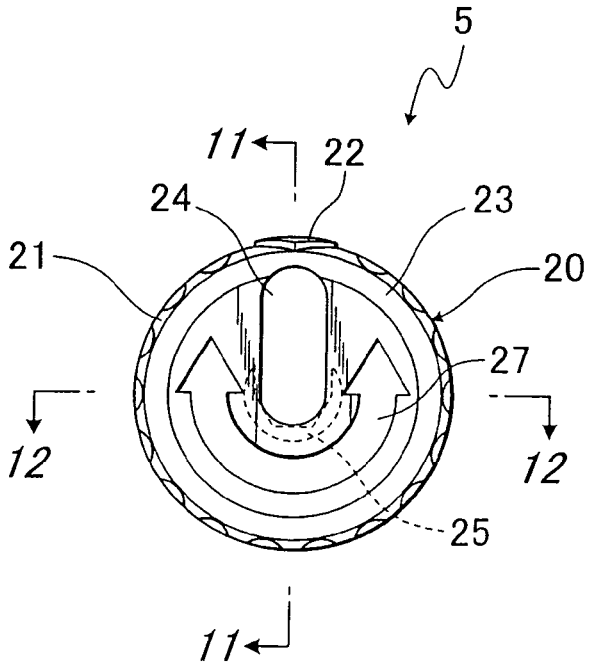
FIG. 8 is a front view of a cap of the driving tool.
Figure 9:
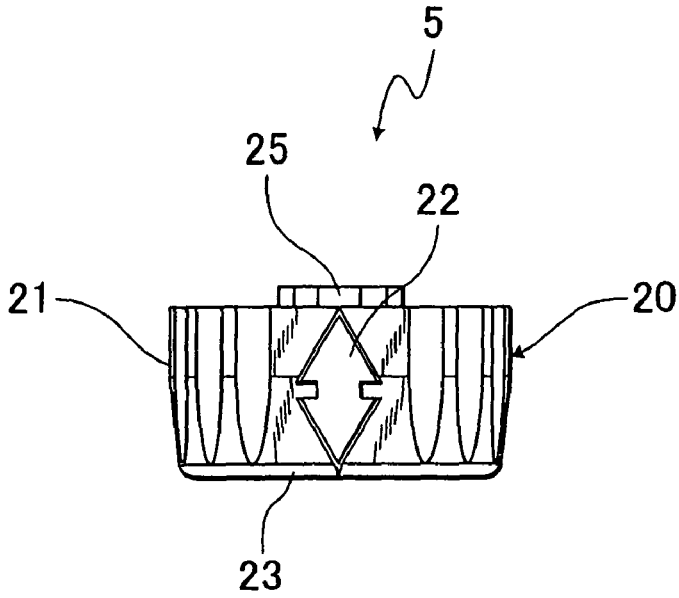
FIG. 9 is a top view of the cap of FIG. 8.
Figure 10:
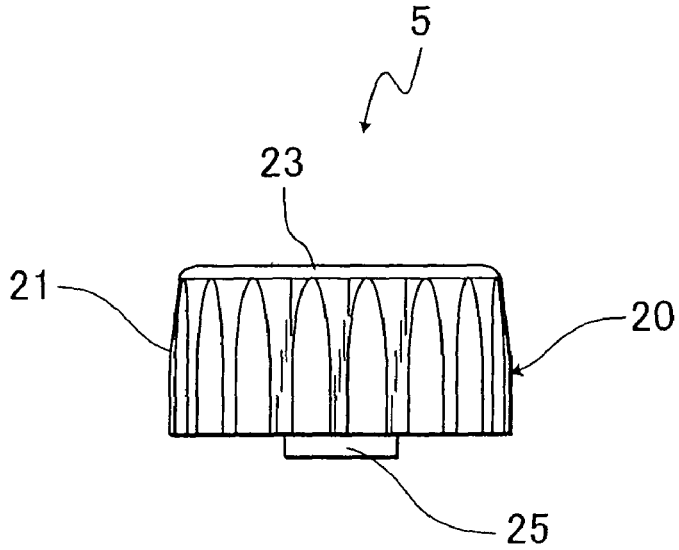
FIG. 10 is a bottom view of the cap of FIG. 8.
Figure 11:
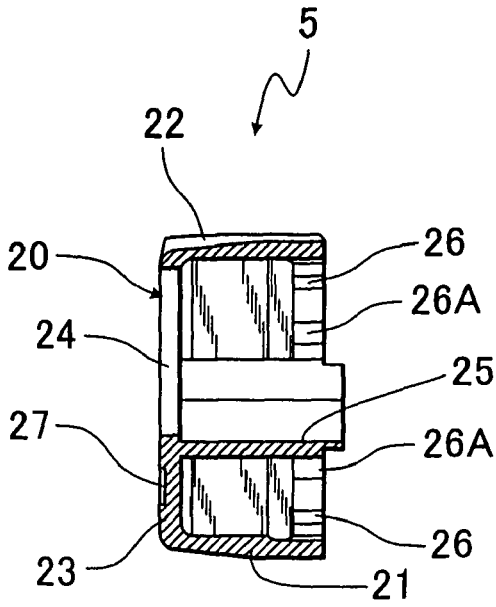
FIG. 11 is a cross section taken along 11-11 line of FIG. 8.
Figure 12:
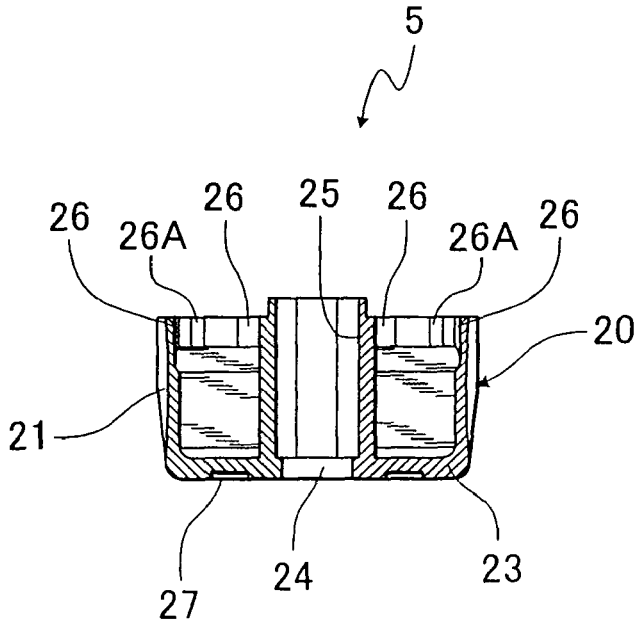
FIG. 12 is a cross section taken along 12-12 line of FIG. 8.

Cap 5 is shown in FIG. 8 or FIG. 12, and comprises a cap body 20 which attaches removably and rotatably with the cap engaging part 13 of said grip handle 2. A positioning indication 22 is formed in the peripheral wall board 21 of the cap body 20 at the peripheral part thereof. A guide groove 24 of a shape of a long hole can receive and lead the selected driver bit 3 to project and not pull out therefrom, and is formed in top plate 23 with a corresponding positioning indication 22 related with the support crevice 7, The base material 25 has the shape of the outline of said supporter 15. Supporter 15 is formed so that it could project to an inner side on the inner wall surface of the peripheral wall by the side of the central part of the guide groove 24 of the top plate 23 of said cap body 20. Six engaging recesses 26 at the time of the driver bit use are formed in the wall side of the open end of peripheral wall board 21 of said cap body 20 with a prescribed interval, and the engaging recess is engageable with said locking piece 12 and clicks when such engagement occurs. The engaging recesses 26A are provided, and the arrow 27 points to the recess 26A engaged by a respective bit 3.

Figure 13:
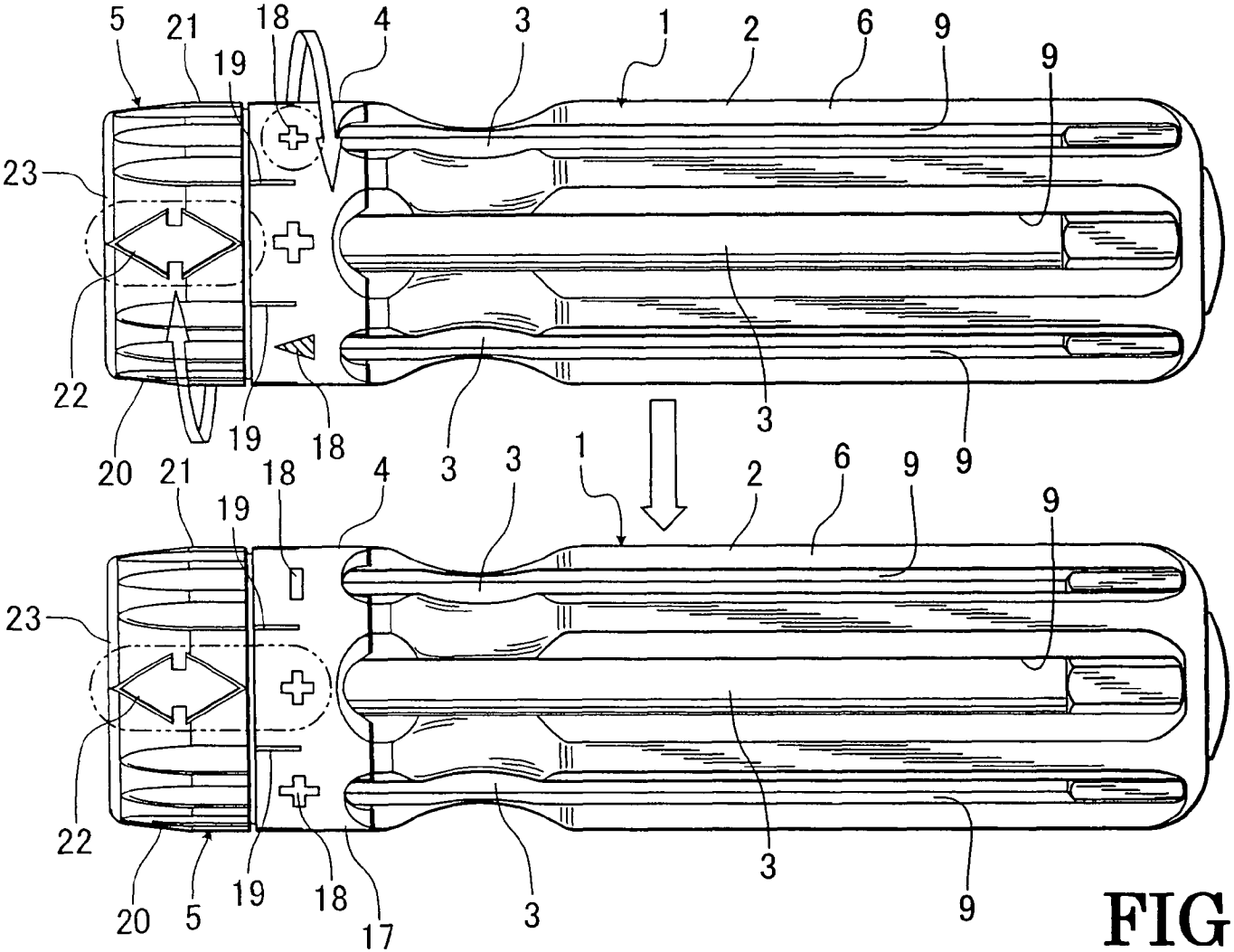
FIG. 13 illustrates positioning of a bit used with the driving tool of the present invention.
Figure 14:
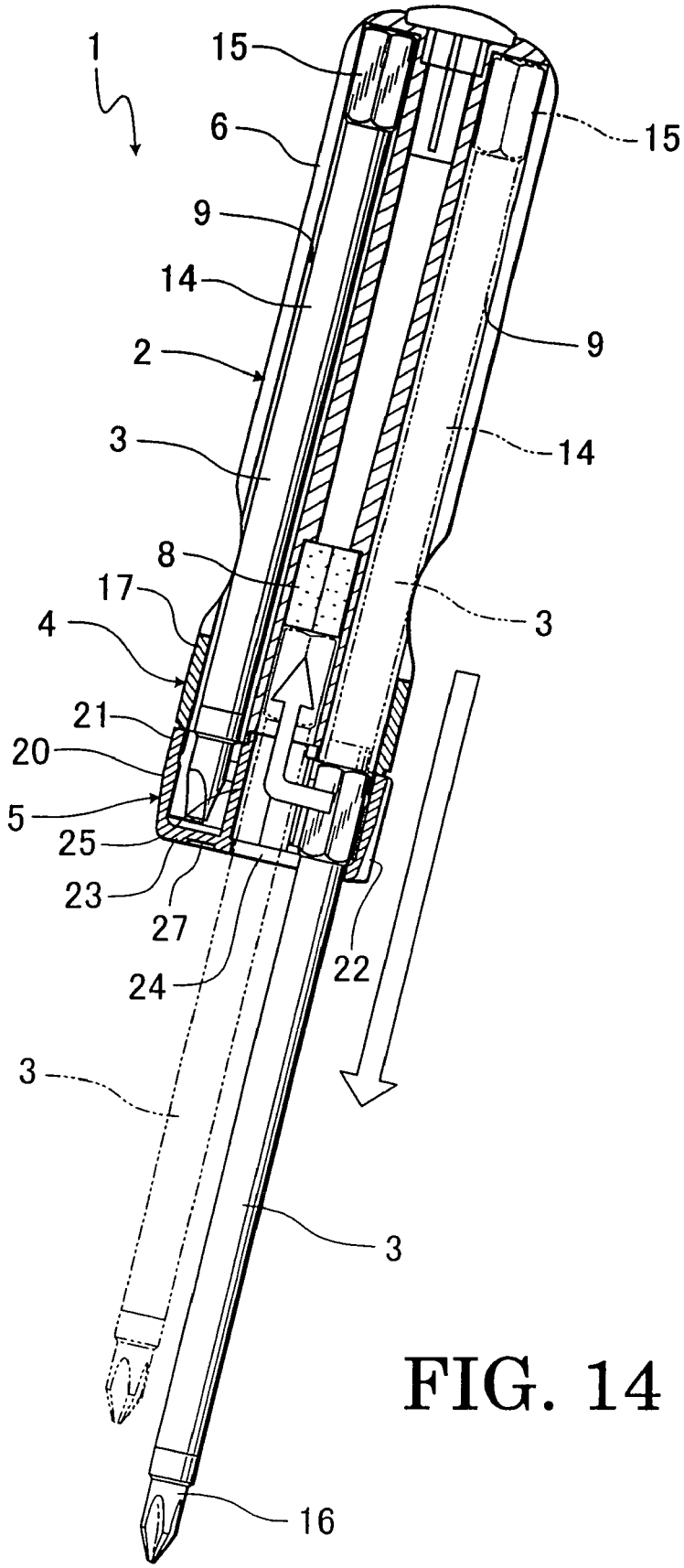
FIG. 14 illustrates projection of a bit used with the driving tool of the present invention.

When using the driving tool of the above-mentioned composition, the indication 18 aligns with the driver bit used as shown in FIG. 13 when cap 5 is rotated and indication 22 is positioned. After an appropriate time, the tip part of handle 2 as shown in FIG. 14 is located below, the supporter 15 of a rear end part is larger than guide groove 24 such that the driver bit 3 to be used will not drop out to the exterior of the handle while projecting from the guide groove 24 of the cap 5.

The bit 3 adsorbs with magnet 8 and is projected to the outside of body 6 as supporter 15 is moved to the central part of body 6 along guide groove 24, and is pushed into support crevice 7.

Figure 15:
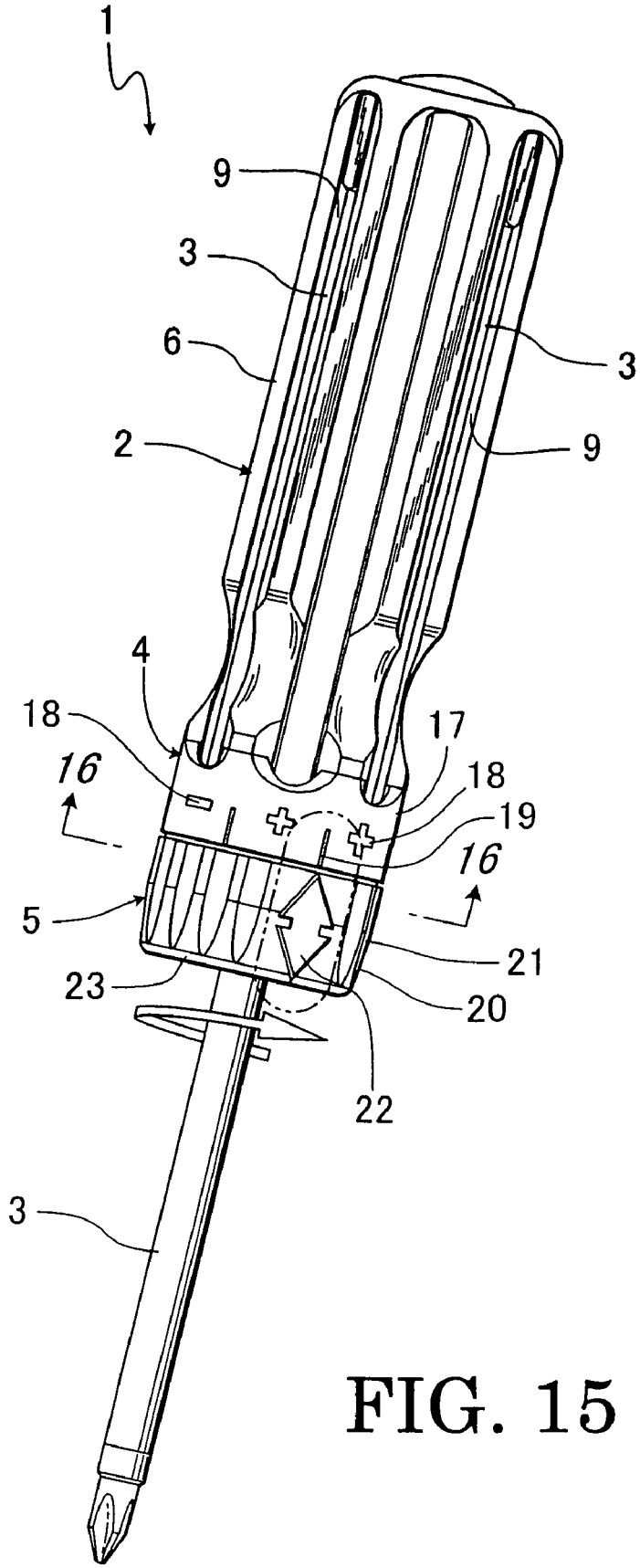
FIG. 15 illustrates locking of a driving bit used with the driving tool of the present invention.

Although it may be used in this state, as shown in FIG. 15, the cap 5 is rotated for a while and the lower end part of base material 25 is located so that supporter 15 of driver bit 3 may not escape from support crevice 7 as by locating positioning indication 22 of cap 5 with lock indication 19 shown in FIGS. 15-16.

While in use, it can prevent certainly that supporter 15 of driver bit 3 separates from support crevice 7, and it can be used safely. When the used driver bit 3 is stored the indication 22 of the cap 5 is located at the indication 18 of the driver bit which is not stored, or in use. After moving driver bit 3 upwards, when the guide groove 24 is pushed in below along the peripheral part, the driver bit 3 is inserted in the driver bit insertion slot 9 such that in the place where the driver bit 3 was inserted in the driver bit insertion slot 9, by rotating the cap 5 for a while and the positioning of the indication 22 is located at the lock indication 19, the guide groove 24 of the cap 5 will be in the state where it is open for free passage to neither of the driver bit insertion slots 9 so that it prevents certainly the driver bits 3 from projecting to the outside of the handle 2 at the time of non-use.

Figure 19:
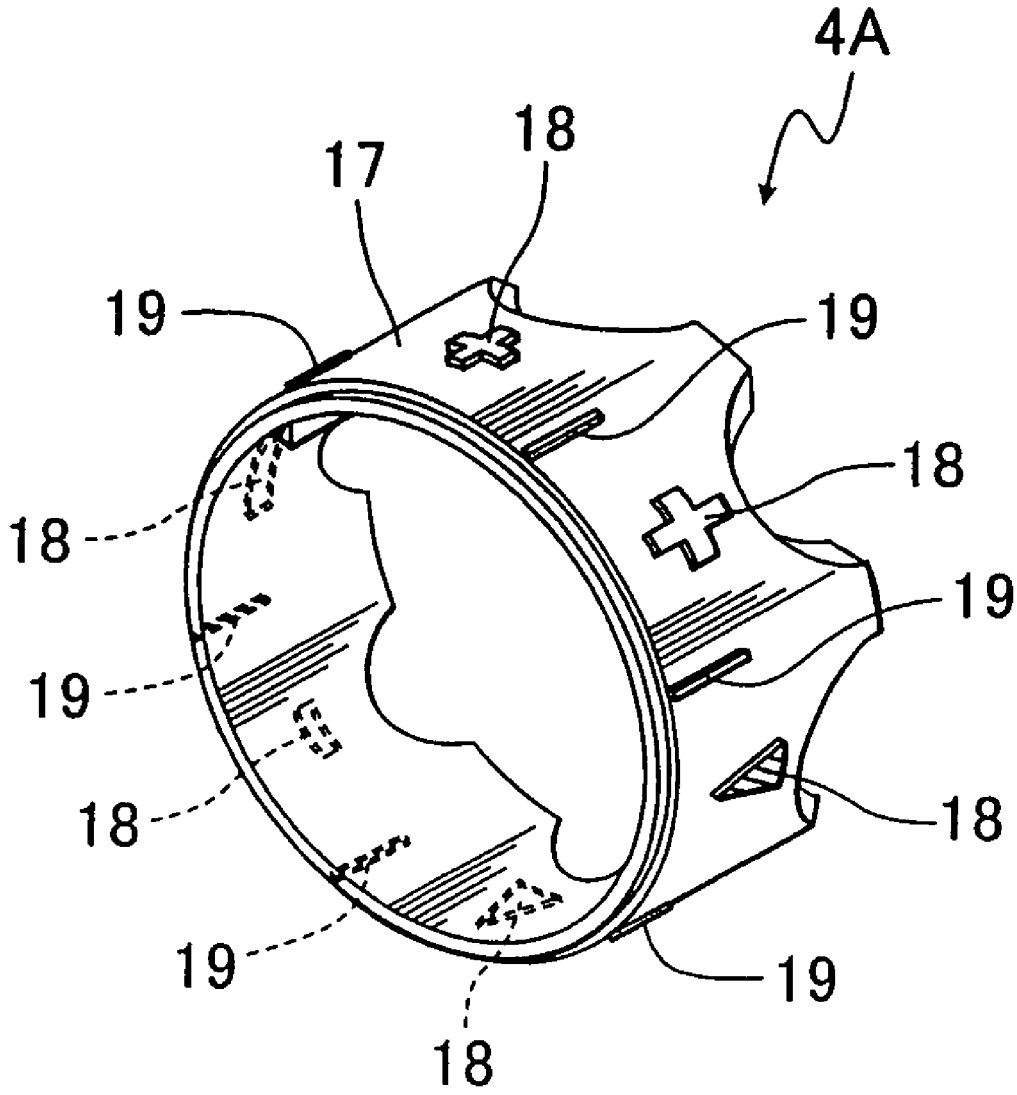
FIG. 19 illustrates the driving tool according to FIG. 17.

Next, a second embodiment for carrying out the invention is shown in FIG. 17 or FIG. 19 and is explained. The explanation gives the same numerals corresponding to identical configuration portions for carrying out the invention.

According to the second embodiment, the retaining ring 4A is displayed with the indications 18 of the driver bit and a part of the lock indications 19 project from the surface of the ring main part 17.

As will be understood from the above:

(1) a guide groove shaped as a long hole receives a driver bit such that a portion thereof excluding its support is projectable outside of the handle body. The base material has the outline shape of the supporter of the driver bit and is formed so that it might project to the inner side in the inside wall of the circumference wall by the side of the central part of the guide groove of the top plate of the cap. The locking piece is formed in the inner wall of the open end of the cap so that it can stop the rotation part which can prevent a plurality of driver bits from entering the guide groove of the cap. Since the driver is constituted by them, the guide groove and base material are attached to the tip part of the grip handle, and one part of the cap in which the plurality of engaging recesses are formed. In the state where the selected driver bit is used, prevention of the projection of the non-used driver bit is obtained, and any one of the driver bits can be stored by the rotation operation of one cap.

(2) construction of the driving tool is simplified and cost of construction is decreased; and (3) selection of a driver bit to be used and storage of a driver bit which is not to be used is reliably obtained through rotation of the cap.

What is claimed is:

1. A driving tool comprising:

a handle having a first end and an opposite cap receiving end, the handle having a central channel and a plurality of second channels concentrically outward of the central channel, each channel extending in a longitudinal direction, the handle comprising a series of projecting portions at the cap receiving end thereof;

a plurality of driving bits housed, respectively, within the handle at the plurality of second channels;

a ring member disposed on the handle and comprising at an outer peripheral surface both a first series of indicators and a second series of indicators, the first series for indicating an associated one of the plurality of driving bits, the second series of indicators being interlaced with the first series of indicators, each one of the second series providing a visually distinct indication of where to align a cap position indicator to define a corresponding unique locked position;

a cap formed as a one-piece cap body rotatably attached to the handle at the cap receiving end, the cap body having a first end, an opposite second end, and an outer peripheral surface between said cap body first and said second end, the cap body first end defining a most distal end of the driving tool when all the driving bits are housed entirely within the handle, the cap body comprising said position indicator at the cap body's outer peripheral surface to be visually and tactilely distinct from a remainder of the cap body's outer peripheral surface and to be elevated to a greater radial height than any of said cap body outer peripheral surface remainder, the cap body having a channel for receiving one of the driving bits, wherein walls of said cap body channel extend longitudinally at said cap body second end for a greater distance than outer peripheral walls of the cap body that define the cap's outer peripheral surface, the cap being rotatable relative to the handle to at least a first and second position, wherein while in the first position the cap body channel is aligned with said central channel and one channel of said plurality of second channels to allow a first driving bit housed within said one channel to be moved out of said one channel into said central channel, wherein while in the second position the cap body channel is not aligned with any of the plurality of second channels and the cap body fixedly engages against the series of projecting portions to secure said first driving bit in the central channel.

2. The driving tool according to claim 1, wherein:

the position indicator aligns with at least one indicator of the first series of indicators and second series of indicators when the cap is rotated to one of said first and second positions.

* * * * *